US008365748B2

(12) United States Patent
Ma

(10) Patent No.: US 8,365,748 B2
(45) Date of Patent: Feb. 5, 2013

(54) CUSHIONING DEVICE FOR UMBRELLA

(76) Inventor: Joen-Shen Ma, Taipei (TW)

( * ) Notice: Subject to any disclaimer, the term of this patent is extended or adjusted under 35 U.S.C. 154(b) by 96 days.

(21) Appl. No.: 13/095,086

(22) Filed: Apr. 27, 2011

(65) Prior Publication Data

US 2012/0273017 A1 Nov. 1, 2012

(51) Int. Cl.
*A45B 25/06* (2006.01)
*A45B 25/08* (2006.01)

(52) U.S. Cl. ..... 135/28; 135/38; 135/40

(58) Field of Classification Search ..... 135/15.1, 135/28, 37, 38, 40, 41
See application file for complete search history.

(56) References Cited

U.S. PATENT DOCUMENTS 152,739 A * 7/1874 Gildersleeve ..... 135/98
2,183,833 A * 12/1939 Farhar ..... 135/20.3
4,132,236 A * 1/1979 Petersen et al. ..... 135/16
4,697,606 A * 10/1987 Ma ..... 135/20.3
5,284,171 A * 2/1994 Liu ..... 135/20.3
6,216,712 B1 * 4/2001 Lin et al. ..... 135/31
2002/0046761 A1 * 4/2002 Liang ..... 135/16

* cited by examiner

*Primary Examiner* — David Dunn
*Assistant Examiner* — Danielle Jackson
(74) *Attorney, Agent, or Firm* — Rosenberg, Klein & Lee

(57) ABSTRACT

A cushioning device for umbrella includes a first gear, a plate spring, a bolt, and a second gear collectively arranged in a hollow chamber defined between a side cover and a casing. The umbrella has a central post to which an axially-extending toothed rack is mounted. The side cover and the casing of the cushioning device are mounted to the runner of the umbrella to have the second gear mating the rack of the central post. The first gear and the second gear of the cushioning device mate each other. The first gear has a surface to which the plate spring and the bolt are mounted. Rotating the bolt to different extents of tightness makes the plate spring apply different depression forces to the first gear, which changes the frictional resistance between the first gear and the casing. The frictional resistance is transmitted through the second gear and the rack to the central post to form a cushioning resistance between the central post and the runner, making the opening operation of the umbrella gentle and safe.

4 Claims, 5 Drawing Sheets

CUSHIONING DEVICE FOR UMBRELLA

BACKGROUND OF THE INVENTION

1. Field of the Invention

The present invention relates to a cushioning device for umbrella, which is attached to a runner of an umbrella to change the magnitude of force that drives the runner to slide along a central post through a simple regulation operation so as to make an umbrella opening operation gentle and safe.

2. The Related Arts

The opening operation of an umbrella is generally carried out by having a runner driving a plurality of ribs upward to open a canopy. Since such an upward movement of the runner requires a great force to open the canopy, an energy device is often provided in the umbrella to increase the kinetic energy applied to the runner. For example, springs are mounted to the ribs to help opening the canopy, or a spring is added to the central post to increase the moving speed of the runner in opening the umbrella.

Increasing the moving speed of the runner in opening the umbrella cause undesired side effect of potential risk of hurting a person standing by the umbrella due to the ribs are fast expanded in a very short period of time, which may have tips of ribs entangling the clothes of the person or impacting the person. Additionally, the fast expansion of the ribs may scare people standing around. Such a problem is often found in the operation of automatic umbrellas.

SUMMARY OF THE INVENTION

To overcome such a problem, the present invention provides a cushioning device for umbrella.

Thus, the primary objective of the present invention is to provide a cushioning device that is attachable to a runner of umbrella to change the force that the runner slides along the central post through a simple operation of adjustment so as to make opening operation of the umbrella gentle and safe.

To achieve this objective, the present invention adopts the following technical solution.

The present invention provides a cushioning device for umbrella, which comprises a first gear, a plate spring, a bolt, and a second gear collectively arranged in a hollow chamber defined between a side cover and a casing.

Further, the umbrella has a central post to which an axially-extending toothed rack is mounted.

The side cover and the casing of the cushioning device are mounted to the runner of the umbrella to have the second gear mating the rack of the central post.

Being arranged inside the casing of the cushioning device, the first gear and the second gear mate each other. The first gear has a surface to which the plate spring and the bolt are mounted.

Rotating the bolt to different extents of tightness makes the plate spring apply different depression forces to the first gear, which changes the frictional resistance between the first gear and the casing.

The frictional resistance is transmitted through the second gear and the rack to the central post to form a cushioning resistance between the central post and the runner, making the opening operation of the umbrella gentle and safe.

BRIEF DESCRIPTION OF THE DRAWINGS

The present invention will be apparent to those skilled in the art by reading the following description of preferred embodiments thereof, with reference to the attached drawings, wherein.

DETAILED DESCRIPTION OF THE PREFERRED EMBODIMENTS

Figure 1:
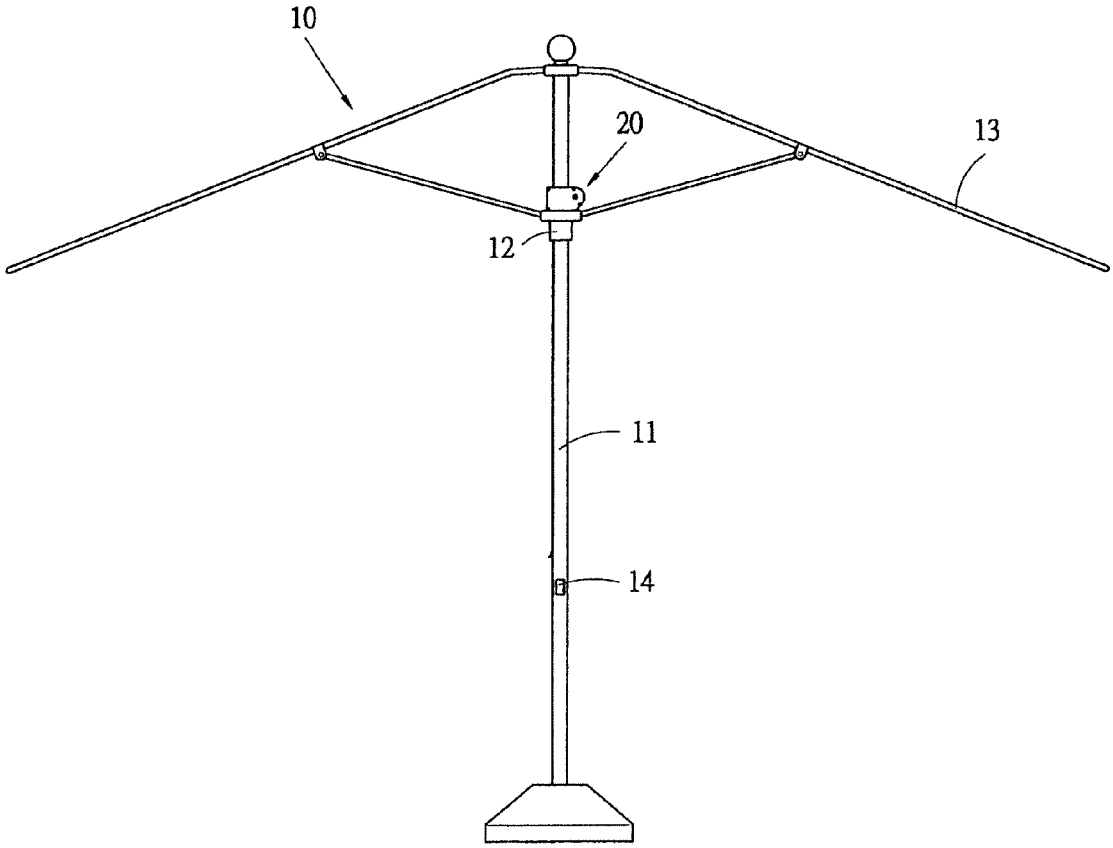
FIG. 1 is a schematic view of an umbrella to which a cushioning device according to the present invention is mounted.

Referring to the drawings, FIG.1 is a schematic view of an umbrella 10 to which a cushioning device 20 according to the present invention is mounted.

Figure 2:
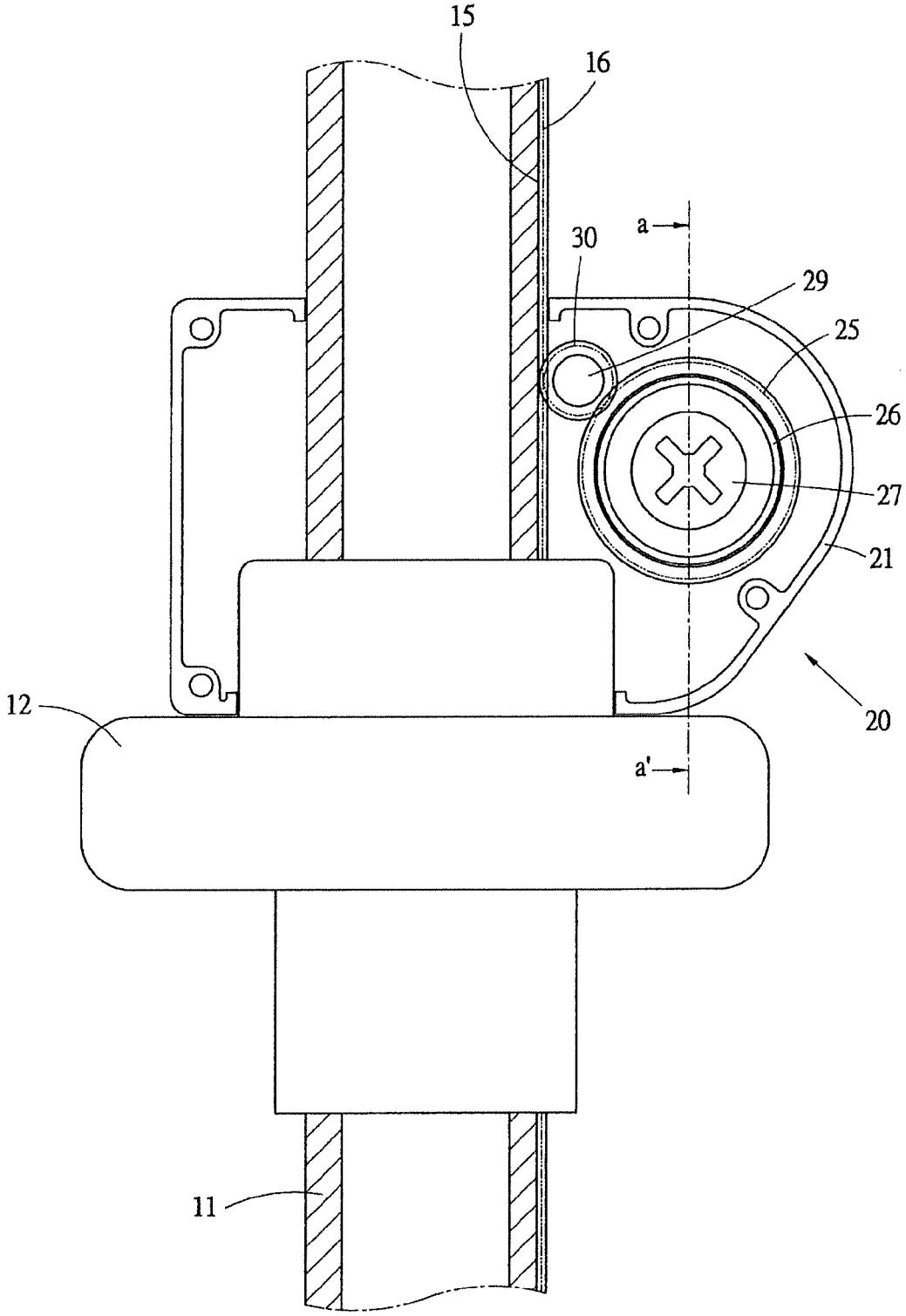
FIG. 2 is a magnified view of the umbrella cushioning device shown in FIG. 1, wherein a central post of the umbrella is shown in a sectioned form and a side cover of the cushioning device is removed to show inside details.

FIG.2 is a magnified view of the umbrella cushioning device 20 shown in FIG.1. In this drawing, a central post 11 of the umbrella is shown in a sectioned form and a side cover 22 of the cushioning device 20 is removed to show inside details.

Figure 3:
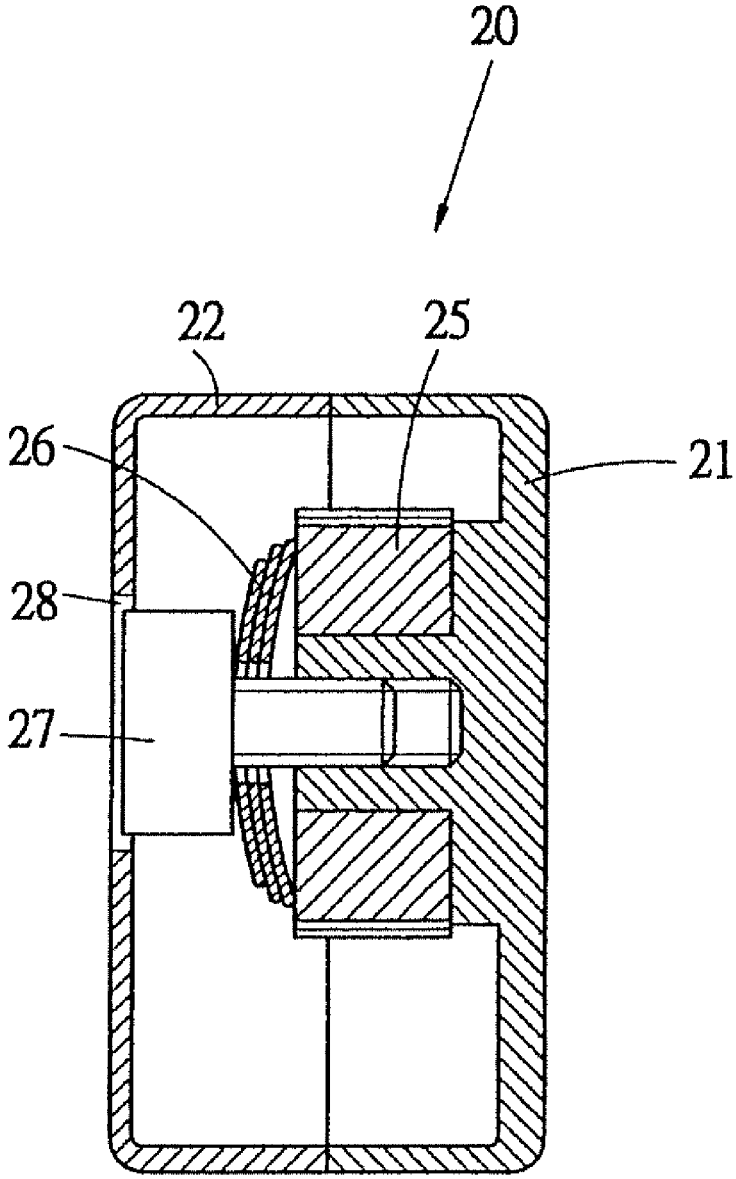
FIG. 3 is a cross-sectional view of the umbrella cushioning device taken along line a-a' of FIG. 2.

FIG.3 is a cross-sectional view of the umbrella cushioning device 20 taken along line a-a' of FIG.2.

Figure 4:
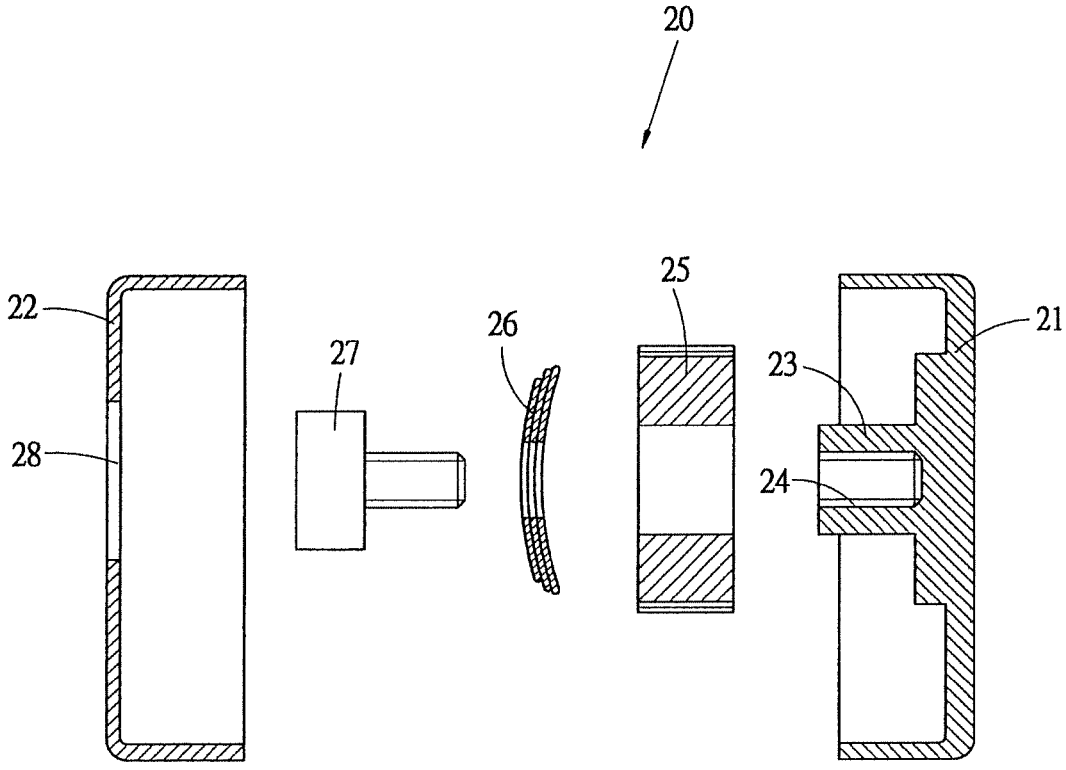
FIG. 4 is an exploded view of the umbrella cushioning device shown in FIG. 3.

FIG.4 is an exploded view of the umbrella cushioning device 20 shown in FIG.3.

As show in FIGS. 2 and 4, the umbrella cushioning device 20 according to the present invention comprises a first gear 25, plate springs 26, a bolt 27, and a second gear 30, which are collectively arranged in a hollow chamber defined between the side cover 22 and the casing 21.

Further, as shown in FIG.2, the umbrella 10 has a central post 11 having an outside surface that is partially recessed to form an axially extending slot 15. The slot 15 receives and retains therein a toothed rack 16.

As shown in FIGS. 1 and 2, the side cover 22 and the casing 21 of the cushioning device 20 are mounted and fixed to a runner 12 of the umbrella 10 and the second gear 30 is arranged to mate the rack 16 that is mounted to the central post 11.

As shown in FIG.4, the cushioning device 20 comprises a first threaded pillar 23 formed on an inside surface of the casing 21 to receive the first gear 25 to rotatably fit thereto. The firs threaded pillar 23 forms a bore in which an internal thread 24 is formed to receive a bolt 27 to screw therein.

As shown in FIG.2, a second threaded pillar 29 is also formed on the inside surface of the casing 21 to receive the second gear 30 to rotatably fit thereto so that the first gear 25 and the second gear 30 mate each other.

As shown in FIG.4, the first gear 25 has a surface on which the plate springs 26 are positioned. Rotating the bolt 27 to tighten forces the plate springs 26 tightly against the first gear 25.

The side cover 22 forms an opening 28, whereby an external tool can extend through the opening 28 to engage the bolt 27 for carrying out rotation and adjustment operation.

As shown in FIG.1, to open the umbrella 10, a user depresses and actuates an umbrella opening button 14 provided on the central post 11, whereby the runner 12 is acted upon by a spring force generated by a spring (not shown) to fast move upward along the central post 11 and thus driving a plurality of ribs 13 of the umbrella to open a canopy (not shown).

As shown in FIG.3, by applying the external tool to rotate the bolt 27 of the cushioning device 20 to different extents of tightness, the plate springs 26 apply different depression forces to the first gear 25, which change a friction-induced resistance between the first gear 25 and the casing 21.

As shown in FIG.2, such a resistance force is transmitted through the second gear 30 and the rack 16 to the central post 11, forming a cushioning resistance between the central post 11 and the runner 12 thereby making the opening operation of the umbrella gentle and safe and effectively eliminating the potential risk of fast expansion of the ribs.

Figure 5:
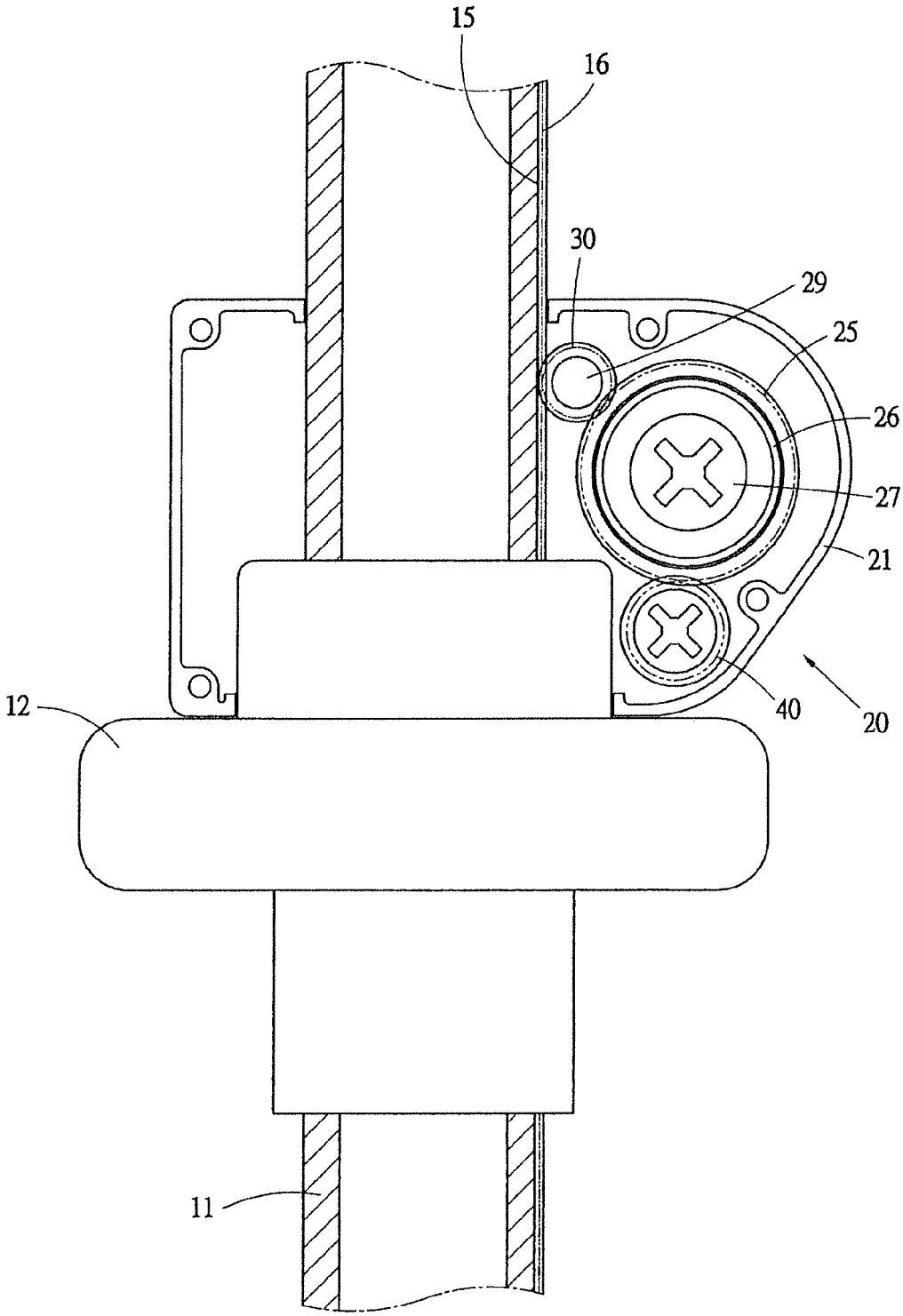
FIG. 5 shows a second embodiment of the cushioning device according to the present invention.

FIG.5 shows a second embodiment of the cushioning device 20 according to the present invention.

In the embodiment shown in FIG.5, a third gear 40 that is capable of adjusting frictional resistance is mounted inside the cushioning device 20 and the third gear 40 is in mating engagement with the first gear 25.

In the embodiment shown in FIG.5, the additionally mounted third gear 40 may work with the first gear 25, so that the cushioning device 20 can provide an even better regulation of the cushioning resistance for the umbrella 10 to allow the device to applicable to various types of umbrella.

An umbrella user may take a simple rotation operation to adjust the cushioning resistance induced by the cushioning device 20 on the umbrella 10 according to practical needs so as to improve safety of opening umbrella.

In manufacture, since the cushioning device 20 according to the present invention uses less parts and has a reduced size, making it possible to occupy less space and attachable to an upper portion of the runner 12 as shown in FIG.1. Alternatively, according to different types of umbrella used, the device of the present invention can be mounted to a lower portion of the runner 12. Both arrangements do not interfere with opening and closing of the umbrella 10.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A cushioning device for umbrella, comprising:

a first gear, a plate spring, a bolt, and a second gear, which are collectively arranged in a hollow chamber defined between a side cover and a casing;

the umbrella having a central post having an outside surface forming a recessed and axially-extending slot, which receives and retains therein a toothed rack;

the side cover and the casing being mounted to a runner of the umbrella, the second gear mating the rack of the central post;

the first gear and the second gear mating each other, the first gear having a surface on which the plate spring and the bolt are mounted;

wherein by rotating the bolt to different extents of tightness makes the plate spring to apply different depression forces to the first gear to change a frictional resistance between the first gear and the casing, the frictional resistance being transmitted through the second gear and the rack to the central post to form a cushioning resistance between the central post and the runner, making opening operation of the umbrella gentle and safe.

2. The cushioning device as claimed in claim 1, wherein the casing has an inside surface on which first threaded pillar is formed to receive the first gear to fit thereto, the first threaded pillar forming a bore in which an internal thread is formed to receive the bolt to screw therein.

3. The cushioning device as claimed in claim 1, wherein the casing has an inside surface forming a second threaded pillar, which receives the second gear to fit thereto, so as to have the first gear and the second gear mating each other.

4. The cushioning device as claimed in claim 1, wherein the casing has an inside surface forming a frictional-resistance-adjustable third gear, the third gear and the first gear mating each other.

* * * * *